United States Patent [19]

Strong et al.

[11] Patent Number: 4,588,074

[45] Date of Patent: May 13, 1986

[54] HOLDER FOR STORING AND SUPPORTING ARTICLES

[75] Inventors: David W. Strong; Patricia A. McGinnis, both of Seattle; James D. Peterson, Bellevue; Steven A. Ballmer, Seattle, all of Wash.; Vern L. Raburn; Dorothy L. Hall, both of Lincoln, Mass.; David A. Fleck, Auburn, Wash.

[73] Assignee: Microsoft Corporation, Bellevue, Wash.

[21] Appl. No.: 715,040

[22] Filed: Mar. 21, 1985

Related U.S. Application Data

[63] Continuation of Ser. No. 527,451, Aug. 29, 1983, abandoned.

[51] Int. Cl.[4] ..... B65D 43/16; A47B 97/04

[52] U.S. Cl. ..... 206/45.15; 206/45.2; 206/45.23; 220/326; 220/338; 220/342; 248/447; 248/458; 248/460

[58] Field of Search ..... 220/324, 326, 329, 332, 220/333, 337, 338, 339, 342, 343; 229/22; 206/44 R, 45.17, 45.2, 45.15, 45.23, 424; 16/366, 262, 370, DIG. 13; 248/447, 459, 460, 461, 462, 441.1, 458

[56] References Cited

U.S. PATENT DOCUMENTS

| | | | |
|---|---|---|---|
| 1,499,712 | 7/1924 | Wilburger | 248/461 X |
| 1,936,319 | 11/1933 | Wingate | 16/366 X |
| 2,008,256 | 7/1935 | Lefevre | 16/370 |
| 2,275,942 | 3/1942 | Barry | 16/366 |
| 2,460,488 | 2/1949 | Brunetti | 220/338 |
| 2,798,597 | 7/1957 | Thompson | 220/337 X |
| 2,960,254 | 11/1960 | Kiba | 220/338 |
| 3,090,271 | 5/1963 | Castelli | 206/45.2 X |
| 3,333,760 | 8/1967 | Bridenstine | 229/2.5 X |
| 3,341,271 | 9/1967 | Nelson | 220/337 X |
| 3,410,391 | 11/1968 | Kanter | 220/324 X |
| 4,108,310 | 8/1978 | Aldridge et al. | 220/339 X |
| 4,466,638 | 8/1984 | Miskin | 248/451 X |

FOREIGN PATENT DOCUMENTS

| | | | |
|---|---|---|---|
| 524240 | 4/1931 | Fed. Rep. of Germany | 248/461 |

*Primary Examiner*—Allan N. Shoap
*Attorney, Agent, or Firm*—Townsend and Townsend

[57] ABSTRACT

A holder (10) is disclosed for storing books and similar articles and for supporting the articles in open position includes a body (14) and a cover (16) hinged together to define a right rectangular polyhedron shape when the holder is closed. The cover (16), which forms the upper portion of the holder (10), is pivotable forwardly and downwardly about a pair of double-acting hinges (18) located along a horizontal centerline on the front wall of the holder (10). The cover (16) includes a top wall (46) which forms the top of the holder (10) when the cover (16) is closed and then lies flat on the surface on which the holder is standing when the cover (16) is open. An abutment lip extends transversely to the rear edge of the top wall (46) to downwardly engage with portions of the rear wall (24) of the body (14) when the cover (16) is closed to serve as a latch and extends upwardly when the cover (16) is open to serve as a stop for the lower edge of an article being supported in upright orientation against the holder (10).

6 Claims, 8 Drawing Figures

HOLDER FOR STORING AND SUPPORTING ARTICLES

This is a continuation of application Ser. No. 527,451 filed Aug. 29, 1983, now abandoned.

BACKGROUND OF THE INVENTION

1. Field of the Invention

The present invention relates to article holders, and more particularly to a dual purpose holder for both storing, and supporting in open position, books, magazines, pamphlets, and similar items.

2. Description of the Prior Art

Holders or cases for both storing and displaying items are known. For example, see U.S. Pat. Nos. 682,522; 1,930,347 and 3,301,621. One type of known holder is composed of two diagonal sections that are hinged together to form a right rectangular polyhedron shape. One section serves as the body of the holder while the other section serves as the cover. When the diagonal sections are closed, the contents of the holder are enclosed and protected and when the cover is swung open, the item contained therein is visible for display. Examples of such holders or cases are found in U.S. Pat. Nos. 4,108,310; 4,320,829; and 4,323,153.

The '310 patent discloses a container for a blood pressure testing kit composed of a pressure gauge, humeral cuff, pump, bleed valve, and stethoscope. All the components of the kit, except the pressure gauge, are stored within the body of the case. The pressure gauge is mounted within the top or cover of the case so that when the case is open, the gauge is in proper orientation to be read. The cover and body are molded from polypropylene in a single piece and are interconnected by a so-called "living hinge" that is integrally molded with the body and cover. A drawback of this particular type of construction is that the polypropylene material composing the hinge is not durable enough to withstand the severe bending occurring each time the cover is opened and closed. However, if the hinge is made in a stronger, more durable manner, i.e., by constructing it from thicker material, the hinge may be too stiff to enable the cover to remain in full open position without springing back into semiclosed position.

The prior art also includes a container for recipe books composed of a body and a cover. The container is opened by pivoting the cover forwardly about a horizontal hinge. The hinge is located below the centerline of the front wall of the container so that the cover is tilted when fully opened, with the forward corner of the cover resting on the surface on which the box is sitting. Upwardly open, deep notches are formed in the sidewalls of the cover to receive and retain the lower edge portion of a recipe book in open position. The upper portion of the recipe book rests rearwardly against the upper forward corners of the container. An example of a recipe container constructed in this manner is disclosed by U.S. Pat. No. 1,930,347. A significant disadvantage of this type of container is that if the recipe book is narrower than the width of the container, it cannot be supported by the notches of the cover. Even if the opened book is wider than the container, because the notches only contact a narrow portion of the book, the pages of the book may slide out of the notches, especially if the book is relatively stiff. Moreover, the book may not be tall enough to rest against the forward edges of the container, and will fall rearwardly against the forward inclined edges of the container sidewalls at an angle that may be inconvenient for the reader.

SUMMARY OF THE INVENTION

The present invention provides a holder for books and similar items that may be used to both store the books and support them in open position at a fixed angle, even if the books are substantially shorter and narrower than the holder. Additionally, the invention provides a stable support structure for a book or similar item that is capable of accommodating discontinuities in the surface on which the structure rests.

In one embodiment of the invention a holder for books and similar items is constructed with a body and a cover hinged to the front portion of the body to pivot between an upward, closed position for enclosing an article in the body, and a downward, open position for supporting the article against the front of the holder. The cover is formed with a top wall that closes off the top of the body. An elongated abutment lip extends transversely downward from he rear edge of the cover top wall to engage with portions of the body when the cover is in closed position. When the cover is in open position, the top wall of the cover is disposed in front of and coplanar with the bottom of the body, and the abutment lip extends upwardly to serve as a stop for the lower edge of the article being supported against the holder.

In another embodiment, the body is formed from front and rear walls interconnected by sidewalls, with the front wall being about one-half the height of the rear wall. The sidewalls have diagonal forward edge portions that slope upwardly and rearwardly from approximately the top of the body front wall to intersect the top of the body sidewalls at locations forwardly of the body rear wall. The cover is constructed from a front wall, a top wall and parallel sidewalls having diagonal rear edges sloped complementarily to the diagonal forward edges of the body sidewalls to extend upwardly and rearwardly from approximately the lower edge of the cover front wall to intersect the cover top wall at locations spaced forwardly of the rear edge portion of the cover top wall. When the cover is in closed position, the corresponding diagonal edges of the body and cover sidewalls are in contacting, abutting relationship to each other. When in open position, the cover overlies the body front wall and the diagonal edges of the corresponding cover and body sidewalls are in longitudinal alignment with each other.

In a further aspect of the present invention, the body and cover are interconnected by double-acting hinges composed of a link member pivotally secured to the upper edge portion of the container front wall and the lower edge portion of the cover front wall at spaced-apart locations along the link member. Clearance notches are formed in the front walls of the cover and body for receiving the link member. Pairs of aligned pins extend outwardly from the side edges of the notches to engage within corresponding aligned sockets formed in the side edges of the link members. Conversely, the pins may stick outwardly from the side edges of the link members to engage within corresponding sockets formed in the side edge portions of the clearance notches.

DETAILED DESCRIPTION OF THE PREFERRED EMBODIMENT

Figure 1:
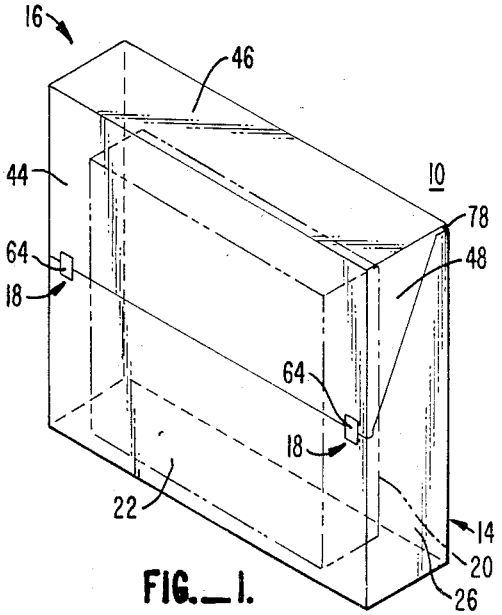
FIG. 1 is an isometric view of a holder constructed according to the present invention.
Figure 3:
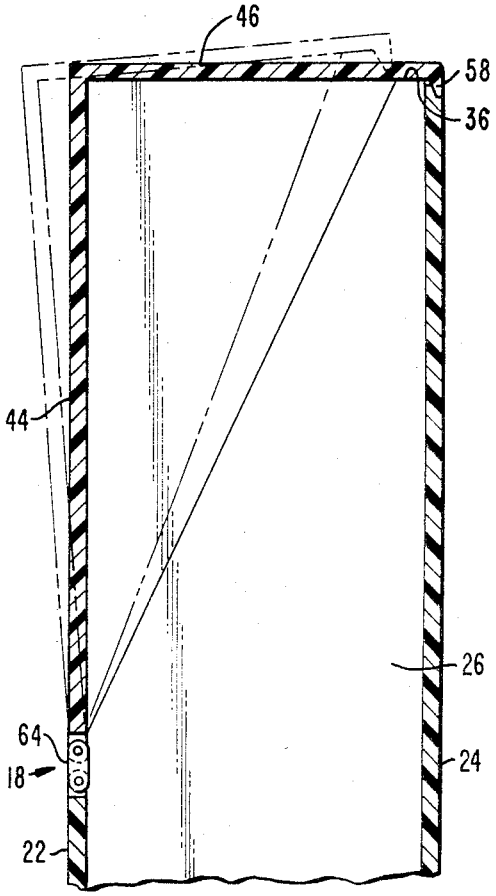
FIG. 3 is an enlarged, fragmentary, side elevation cross-sectional view of a portion of the holder illustrated in FIG. 4, taken through one of the hinges thereof.
Figure 2:
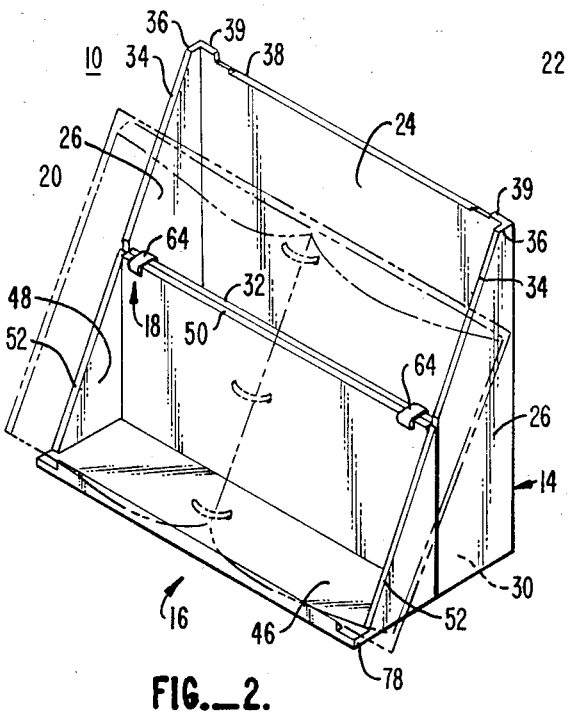
FIG. 2 is an isometric view similar to FIG. 1, but with the cover disposed in an open position.

FIGS 1 and 2 illustrate a preferred embodiment of a holder 10 constructed from a body 14 and a cover 16 that together define a right rectangular polyhedron shape. Cover 16 is mounted on body 14 by a pair of spaced-apart hinges 18 to pivot between a closed position, shown in FIG. 1, for containing and protecting the contents of the holder, such as book 20, and an open position, shown in FIG. 2, for supporting the book at an angle that is convenient for the reader. Preferably, holder 10 is constructed from a transparent material to permit the contents of the holder to be identified without requiring any external labels.

Figure 4:
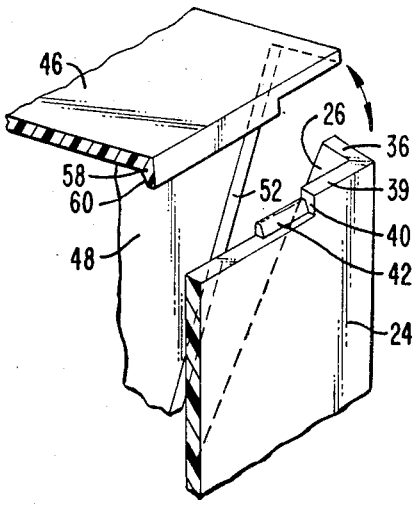
FIG. 4 is an enlarged, fragmentary, isometric view of an upper rear corner of the holder illustrating the cooperation between the cover and body of the holder as the cover is being closed.
Figure 5:
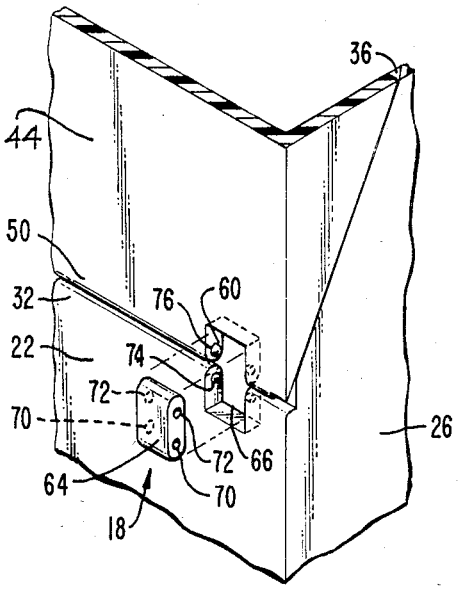
FIG. 5 is an enlarged, fragmentary, isometric view of the present invention specifically illustrating the construction of the hinge used to interconnect the cover and body.
Figure 7:
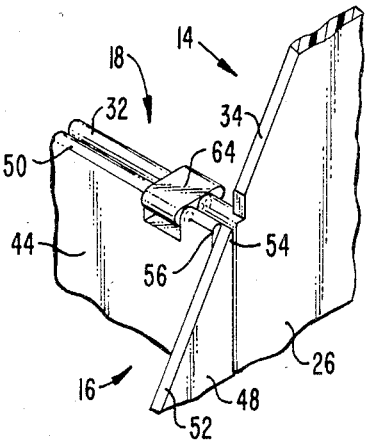
FIG. 7 is an enlarged, fragmentary, isometric view of the hinge illustrated in FIGS. 5 and 6 showing the position of the hinge when the cover is in open position.

Body 14 is constructed from planar front and rear walls 22 and 24 separated from each other in spaced, parallel relationship by a pair of planar sidewalls 26 that are also parallel to each other. The lower edges of the front, rear, and sidewalls intersect with a planar bottom wall 30 that closes off the bottom of body 14. Preferably, front wall 22 extends upwardly from bottom wall 30 to approximately one-half of the height of holder 10 to terminate at a horizontal upper edge 32 that is rounded in transverse cross section as shown in FIG. 7. The lower portions of sidewalls 26, up to a height slightly above the elevation of the upper edge 32 of front wall 22, are rectangular in shape, while the upper portions of the sidewalls, above upper edge 30, are generally triangular in shape. This triangular shape is in part defined by forward edges 34 that extend diagonally upwardly and rearwardly from front wall 22 to intersect with upper edges 36 of sidewalls 26 at a location slightly forward of rear wall 24. A shallow notch 38 is formed in the upper edge portion 39 of rear wall 24 to extend substantially the entire length of the wall, as shown in FIG. 2. A relatively short end wall 40 extends upwardly from each end of notch 38 to terminate at the upper edge 39 of rear wall 24. As shown by FIG. 4, a catch 42 extends aong a short distance of each end of notch 38. Catch 42 is generally triangular in cross section, with the altitude of the catch disposed flush with the inside surface of rear wall 24 and the hypotenuse of the catch extending diagonally downwardly and rearwardly from the top of the catch to intersect the base of the triangle at approximately the center of the thickness of the rear wall.

Figure 8:
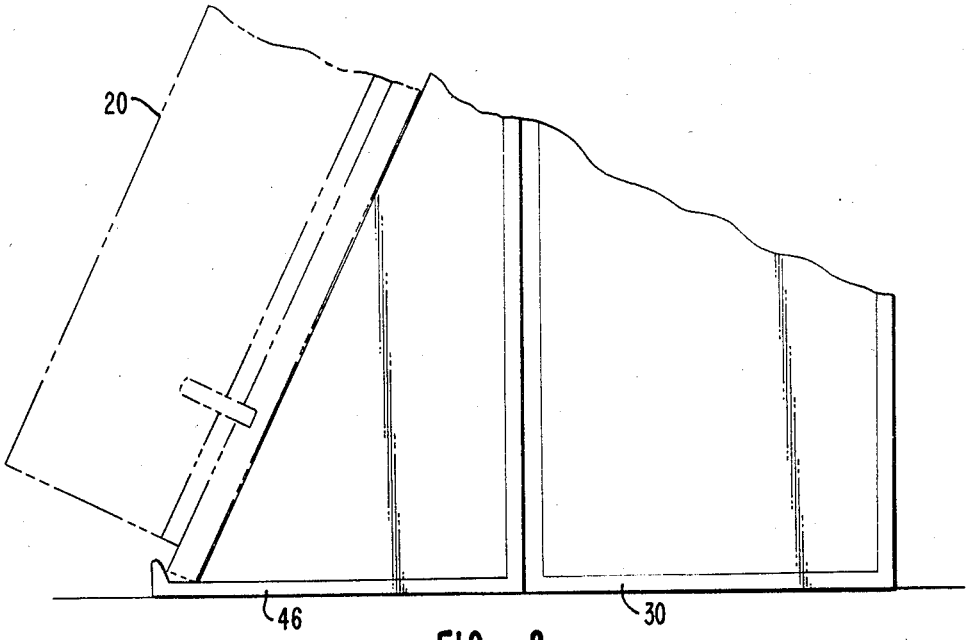
FIG. 8 is an enlarged, fragmentary side elevational view of the lower portion of the holder with the cover in open position, specifically illustrating a book being supported in open position.

When the holder is closed, cover front wall 44 is disposed coplanar with body front wall 22 and extends upwardly from the upper edge 32 of the body front wall to the top of holder 10 as defined by top wall 46. Ideally, the height of cover front wall 44 is the same as the height of body front wall 22 so that when the cover is opened, cover top wall 46 is coplanar with bottom wall 30 of body 14, as shown in FIGS. 2 and 8. Also, preferably, the lower edge 50 of cover front wall 44 is rounded in cross section in a manner similar to the shape of the upper edge 32 of body front wall 22.

The triangular shape of the cover sidewalls 48 is in part defined by the diagonal edges 52 that extend upwardly from the lower edge of front wall 44 to intersect top wall 46 at a location spaced a short distance forward of the rear edge of the top wall, which distance corresponds to the length of the upper edges 36 of body sidewalls 26. When cover 16 is closed, as illustrated in FIG. 1, diagonal edges 52 of cover sidewalls 44 abut with corresponding edges 34 of body sidewalls 26. When the cover is open, as shown in FIG. 2, corresponding edges 52 and 34 are in longitudinal alignment with each other to define a continuous sloped edge portion at each side of holder 10.

As shown in FIG. 7, when the cover is open, edges 52 of cover sidewalls 48 intersect the forward surface of the front wall 44 at relatively sharp corners 54. As a result, a vertical shoulder portion 56 is formed at each end of the lower edge 50 of front wall 44. When cover 16 is closed, shoulders 56 bear against the adjacent inside surface of body sidewalls 26 to minimize lateral movement of the cover relative to the body 14. As a result, transverse loads imposed on cover 16, for example, during opening and closing of the cover, are carried by the sidewalls of body 14 rather than by hinges 18.

An elongated lip 58 shown in FIG. 2 depends downwardly from the rear edge of cover top wall 46 to engage within notch 38 formed in the upper edge of body rear wall 24. The ends of lip 58 are receivable between the two end walls 40, one at each end of notch 38, also to position cover 16 laterally relative to the rear wall 24, and prevent the cover from shifting sideways relative to the body when the cover is closed. In cross section, lip 58 is formed in a triangular shape corresponding with the shape of catches 42 at each end of notch 38. Lip 58 includes a portion 60 that is "snapped" over catch 42 to loock cover 16 in closed position. When cover 16 is closed, the rear corners of top wall 46 are supported by upper edges 36 of sidewalls 28, the edges 39 and 36 of wall 24 and sidewalls 26. In addition to serving as a latch for cover 16, lip 58 also functions as a stop for the lower edge of book 20 when cover 16 is open, as shown in FIGS. 2 and 8.

As illustrated in FIGS. 1–3 and 5–7, cover 16 and body 18 are interconnected by a pair of spaced apart, double-acting hinges 18 located along the horizontal centerline of holder 10. Each hinge is composed of a rectangular shaped link member 64 pivotally secured to the upper edge portion 32 of body forward wall 22 and the lower edge portion 50 of cover forward wall 44. Clearance slots 66 and 68 are formed in walls 22 and 24 for receiving the link members. In a preferred embodiment, two pairs of aligned, spaced-apart, cone-shaped sockets 70 and 72 are formed in the side edges of link members 64 to pivotally receive correspondingly shaped and sized pins in the form of studs 74 and 76 extending outwardly from the wide edges of slots 66 and 68. Studs 74 and 76 are engaged within corresponding sockets 70 and 72 by deflecting the edge portions 32 and 50 of front walls 22 and 24 located adjacent slots 66 and 68. The rounded edges 32 and 50 of body and cover front walls enable cover 16 to freely pivot relative to body 14 without interference while minimizing the clearance required between the edges. The distance separating sockets 70 from sockets 72 corresponds to the distance separating studs 74 and 76 so that when open cover 16 contacts wall 22. The face-to-face contact between the cover and walls 44 and 22 helps stabilize holder 10 when supporting book 20.

Figure 6:
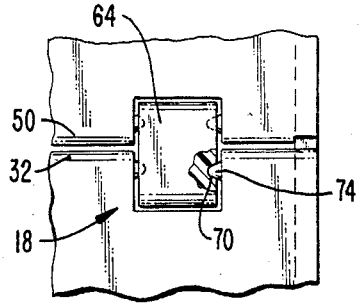
FIG. 6 is an enlarged, fragmentary, front elevational view of the hinge shown in FIG. 5, with portions broken away for clarity.

Link members 64 are constructed from the same type and gauge of material that is utilized to form body and cover 16 so that when the cover is closed, the link members are flush with body front wall 22 and cover front wall 4. This enhances the appearance of the holder and prevents the hinges from catching or striking external objects. The upper and lower edges of link members 64 are rounded to enable the link members to freely pivot relative to body front wall 22 and cover front wall 44 from a vertical position when the cover is closed, as shown in FIG. 6, to a horizontal position when the cover is open, as shown in FIG. 7. Link members 64 occupy substantially the entire areas defined by slots 66 and 68 to avoid creating openings of any significant size in holder 10 through which dirt of other foreign matter may enter the holder. It will be appreciated that by the above-described construction of hinges 18, when cover 16 is disposed in open position, the double action of hinges 18 permits the cover 16 to shift a short distance upwardly or downwardly relative to body 14 to accommodate a certain amount of unevenness or discontinuity that may exist in the surface on which the container rests.

Holder 10 serves as a convenient case or container for storing articles, such as book 20. When cover 16 is latched closed by engagement of lip 58 with catches 42, the article is protected against moisture, dust, and other elements. Moreover, by forming the holder from transparent material, the contents of the holder may be readily ascertained without opening the cover.

Cover 16 is opened by pushing horizontally against lip 58 in a direction toward the front of the container to disengage the lip from catches 42 and swing the cover downwardly about hinges 18 through 180° to abut against front wall 22 of body 14. Thereafter, book 20 may be removed from the holder, opened to a desired page and then placed on the inside surface of cover top 46, which extends forward of sidewalls 48, so that cover lip 58 abuts against the lower edge of the book to maintain the book in upright, open position. The aligned diagonal edges 52 of cover sidewalls 48 and edges 34 of body sidewalls 26 cooperatively form a slanted backrest to support the back of the book. The back of the book is also supported by the horizontal lower edge 50 of cover 16, which is particularly useful for narrower books that do not extend outwardly far enough to bear against the slanted side edges of the holder.

As will be apparent to those skilled in the art to which the invention is addressed, the present invention may be embodied in forms other than those specifically disclosed above without departing from the spirit or essential characteristics of the invention. The particular embodiments of holder 10, described above, are therefore to be considered in all respects as illustrative and not restrictive. For example, it will be appreciated that the dimensions and proportions of the holder will be adapted to accommodate different sizes and types of books or other articles. The scope of the present invention is as set forth in the appended claims rather than being limited to the examples of holder 10 set forth in the foregoing description.

I claim:

1. A box for containing a manual during shipment and storage and for supporting the manual during use, the manual having bound material contained within a cover, the cover protruding and extending below the bound material to define a lower lip when the cover is opened and the bound material of the manual is being read, the box comprising in combination:

said box for containing the manual, the box having a front wall, a rear wall, a bottom wall, a top wall and two side walls;

a hinge for opening the box, said hinge located on the front wall having a hinge axis half the distance from the top wall and bottom wall along the front wall;

the hine joining the box in two discrete sections including a container portion and a cover portion;

the cover portion including the top wall, the top half of the front wall and two wedge-shaped portions of the side walls;

the cover portion when open disposing the top wall coplanar to the bottom wall with the wedge-shaped sections of the side walls attached to the cover portion cooperating with the remaining side walls attached to the container portion to form from the opened cover portion and adjoined container portion a slanting support surface for supporting the manual in a reading position;

the top wall having a latch portion, the latch portion protruding downwardly from the inside surface of the top wall into the plane of the rear wall when the cover portion is in the closed position;

the latch portion of the top wall protruding upwardly from the inside surface of the top wall to form a retaining edge when the cover portion is in the open position;

the lower lip of the manual cover being receivable at the latch portion to maintain the manual cover against the base of the wedge-shaped sections of the side walls whereby the manual when removed from the box can be supported in the reading position with the lower lip held by the latch portion on the top wall while the cover of the manual rests against the wedge-shaped sections of the side walls.

2. A box according to claim 1 wherein the hinge comprises link means at spaced-apart locations along the hinge axis, said link means including means for pivotally attaching the top half of the front wall and the bottom half of the front wall.

3. A box according to claim 3 wherein means for pivotally securing the link means to the top half of the front wall and to the bottom half of the front wall include socket means located on said link means and pin means, said pin means receivable in said socket means.

4. A box and manual contained in the box wherein the box is for containing the manual during shipment and storage and for supporting the manual during use, comprising in combination:

said manual having bound material contained within a cover, the cover protruding and extending below the bound material to define a lower lip when the cover is open and the bound material of the manual is opened for reading;

said box having a front wall, a rear wall, a bottom wall, a top wall and two side walls;

a hinge for opening the box, said hinge located on the front wall having a hinge axis half the distance from the top wall and bottom wall along the front wall;

the hinge joining the box in two discrete sections including a container portion and a cover portion;

the cover portion including the top wall, the top half of the front wall and two wedge-shaped portions of the side walls;

the cover portion when open disposing the top wall coplanar to the bottom wall with the wedge-shaped sections of the side walls attached to the cover portion cooperating with the remaining side walls attached to the container portion to form a slanting support surface for supporting the manual in a reading position;

the top wall having a latch portion, the latch portion protruding downwardly from the inside surface of the top wall into the plane of the rear wall when the cover portion is in the closed position;

the latch portion of the top wall protruding upwardly from the inside surface of the top wall to form a retaining edge when the cover portion is in the open position; and the lower lip of the manual cover being receivable at the latch portion to maintain the manual cover against the base of the wedge-shaped sections of the side walls whereby the manual when removed from the box can be supported in the reading position with the lower lip held by the latch portion on the top wall while the cover of the manual rests against the wedge-shaped sections of the side walls.

5. A box according to claim 4 wherein the hinge comprises link means at spaced-apart locations along the hinge axis, said link means including means for pivotally attaching the top half of the front wall and the bottom half of the front wall.

6. A box according to claim 5 wherein means for pivotally securing the link means to the top half of the front wall and to the bottom half of the front wall include socket means located on said link means and pin means, said pin means receivable in said socket means.

* * * * *